US008988001B2

(12) United States Patent
Lin et al.

(10) Patent No.: US 8,988,001 B2
(45) Date of Patent: Mar. 24, 2015

(54) LAMP AND ILLUMINATION SYSTEM AND DRIVING METHOD THEREOF

(75) Inventors: Chih-Hua Lin, Hsin-Chu (TW); Yu-Chin Lan, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 570 days.

(21) Appl. No.: 13/183,475

(22) Filed: Jul. 15, 2011

(65) Prior Publication Data

US 2012/0074862 A1 Mar. 29, 2012

(30) Foreign Application Priority Data

Sep. 29, 2010 (TW) ..... 99133096 A

(51) Int. Cl.
*H05B 37/02* (2006.01)
*H05B 33/08* (2006.01)

(52) U.S. Cl.
CPC ..... *H05B 33/0845* (2013.01)
USPC ..... 315/291; 315/246

(58) Field of Classification Search
USPC ..... 315/246, 291
See application file for complete search history.

(56) References Cited

U.S. PATENT DOCUMENTS 3,354,266 A 11/1967 Dinenno
6,624,593 B2 * 9/2003 Blanchard ..... 315/209 R
6,788,006 B2 * 9/2004 Yamamoto ..... 315/219
7,038,399 B2 5/2006 Lys et al.
7,560,677 B2 7/2009 Lyons et al.
7,642,734 B2 * 1/2010 De Anna ..... 315/308
8,111,012 B2 * 2/2012 Sanchez ..... 315/307
2004/0239262 A1 * 12/2004 Ido et al. ..... 315/291
2009/0184666 A1 7/2009 Myers et al.
2011/0163684 A1 * 7/2011 Li et al. ..... 315/254

FOREIGN PATENT DOCUMENTS

TW I297819 6/2008
TW M371263 12/2009
TW 201002156 1/2010
TW 201019008 5/2010
TW M381241 5/2010

OTHER PUBLICATIONS

"Office Action of Taiwan Counterpart Application", issued on Oct. 3, 2013, p. 1-p. 8.

* cited by examiner

*Primary Examiner* — Thuy Vinh Tran
(74) *Attorney, Agent, or Firm* — Jianq Chyun IP Office

(57) ABSTRACT

A lamp and an illumination system and a driving method thereof are provided. The lamp includes a lighting unit, a conversion unit, and a driver. The conversion unit is capable of receiving an input pulse width modulation (PWM) signal and converting the input PWM signal into an output PWM signal, wherein a frequency of the input PWM signal and a frequency of the output PWM signal are different. The driver is coupled between the lighting unit and the conversion unit. The driver is capable of receiving the output PWM signal and generating a driving signal to drive the lighting unit according to the output PWM signal.

18 Claims, 2 Drawing Sheets

| PWM_I_D | PWM_O_D |
|---|---|
| 0%~5% | 100% |
| 5.1%~94.9% | $(96\%-PWM_I_D)\times\frac{100}{91}$ |
| 95%~100% | 0% |

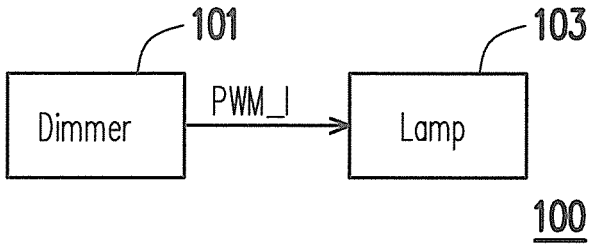
FIG. 1
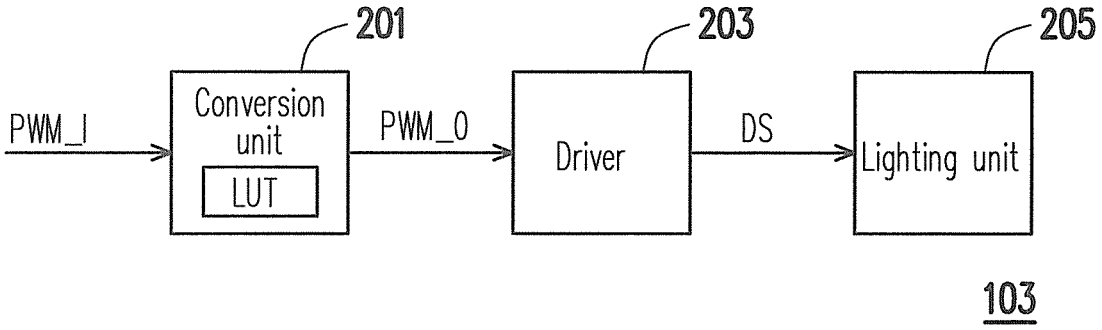
FIG. 2
| PWM_I_D | PWM_O_D |
|---|---|
| 0%~5% | 100% |
| 5.1%~94.9% | $(96\%-PWM_I_D)X\frac{100}{91}$ |
| 95%~100% | 0% |
FIG. 3

LAMP AND ILLUMINATION SYSTEM AND DRIVING METHOD THEREOF

CROSS-REFERENCE TO RELATED APPLICATION

This application claims the priority benefit of Taiwan application serial no. 99133096, filed on Sep. 29, 2010. The entirety of the above-mentioned patent application is hereby incorporated by reference herein and made a part of this specification.

BACKGROUND OF THE INVENTION

1. Field of the Invention

The invention relates to a lamp and an illumination system and a driving method thereof, and more particularly, to a light emitting diode (LED) lamp and an illumination system and a driving method thereof.

2. Description of Related Art

In the past 20 years, people have been working hard on the development of new illumination sources. It is specified in the "Rainbow Project" funded by the European Union (EU) that a new illumination source should satisfy such four conditions as high efficiency, low power consumption, zero pollution, and close resemblance to natural light. Because a light emitting diode (LED) possesses aforementioned characteristics and is far superior to conventional illumination sources (for example, incandescent lamp and fluorescent lamp), the LED is widely considered a green light source in the 21$^{st}$ century and adopted for replacing incandescent lamp and fluorescent lamp as a leading product in the illumination source market.

Generally speaking, an LED lamp with a dimming function directly emits light according to a pulse width modulation (PWM) signal generated by a dimmer. To be specific, a driver in the LED lamp directly drives the LEDs according to the PWM signal generated by the dimmer. Besides, a frequency of the driving signal generated by the driver in the LED lamp according to the PWM signal generated by the dimmer for driving the LEDs is equal to a frequency of the PWM signal generated by the dimmer.

However, because the PWM signals generated by dimmers from different manufacturers have different but fixed frequencies (usually fall within a range of 100 Hz-1 KHz), if the selected dimmer generates a PWM signal of a low but fixed frequency (for example, 100 Hz), flickering of the light source provided by the LED lamp is easily detected by the human eye (this is because the frequency of the PWM signal generated by the dimmer is very close to the frequency range detectable to the human eye).

On the other hand, if the selected dimmer generates a PWM signal of a high but fixed frequency (for example, 1 KHz), signal interference between different components of the driver in the LED lamp is greatly increased, and the complexity in designing an electromagnetic-interference-free (EMI-free) circuit is greatly increased (this is because the frequency of the PWM signal generated by the dimmer not only interferes with the signal transmission between different components of the driver in the LED lamp but also increases the overall EMI index of the LED lamp).

Additionally, the Taiwan Patent No. M381241, M371263, and 1297819, the Taiwan Patent Publication No. 201019008, and the U.S. Pat. Nos. 7,560,677 and 7038399 disclose techniques for driving an LED lamp.

SUMMARY OF THE INVENTION

Accordingly, the invention provides a light emitting diode (LED) lamp and an illumination system and a driving method thereof, wherein problems in conventional techniques are effectively resolved.

Additional aspects and advantages of the invention will be set forth in following description.

According to an embodiment of the invention, a lamp including a lighting unit, a conversion unit, and a driver is provided. The conversion unit is capable of receiving an input pulse width modulation (PWM) signal and converting the input PWM signal into an output PWM signal, wherein a frequency of the input PWM signal and a frequency of the output PWM signal are different. The driver is coupled between the lighting unit and the conversion unit. The driver is capable of receiving the output PWM signal and generating a driving signal to drive the lighting unit according to the output PWM signal.

According to another embodiment of the invention, an illumination system including a dimmer and a lamp is provided. The dimmer is capable of providing an input PWM signal. The lamp is coupled to the dimmer. The lamp is capable of receiving the input PWM signal and provides a light beam according to an output PWM signal related to the input PWM signal, wherein a frequency of the input PWM signal and a frequency of the output PWM signal are different.

According to yet another embodiment of the invention, a method for driving an LED lamp is provided. In the method, an input PWM signal is provided. The input PWM signal is converted into an output PWM signal, wherein a frequency of the input PWM signal and a frequency of the output PWM signal are different. A driving signal is generated to drive the LED lamp according to the output PWM signal.

In embodiments of the invention, the frequency of the output PWM signal has a fixed specific value.

In summary, the embodiment or embodiments of the invention may have at least one of the following advantages. In embodiments of the invention, the driver in the LED lamp generates the driving signal for driving the lighting unit (i.e., LEDs) according to the output PWM signal, and the frequency of the driving signal is equal to the frequency of the output PWM signal instead of the frequency of the input PWM signal. Thus, the problems of conventional techniques may be effectively resolved by appropriately adjusting the frequency of the output PWM signal (for example, to 300 Hz) (in foregoing embodiments, because the frequency of the output PWM signal exceeds a range recognizable to human eyes, the output PWM signal does not interfere with signal transmission between various elements in the driver of the LED lamp or increase the overall electromagnetic interference (EMI) of the LED lamp).

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 1 is a diagram of an illumination system according to an embodiment of the invention.

FIG. 2 is a diagram of a lamp in FIG. 1.

FIG. 3 is a diagram of a built-in lookup table in a conversion unit according to an embodiment of the invention.

Figure 4:
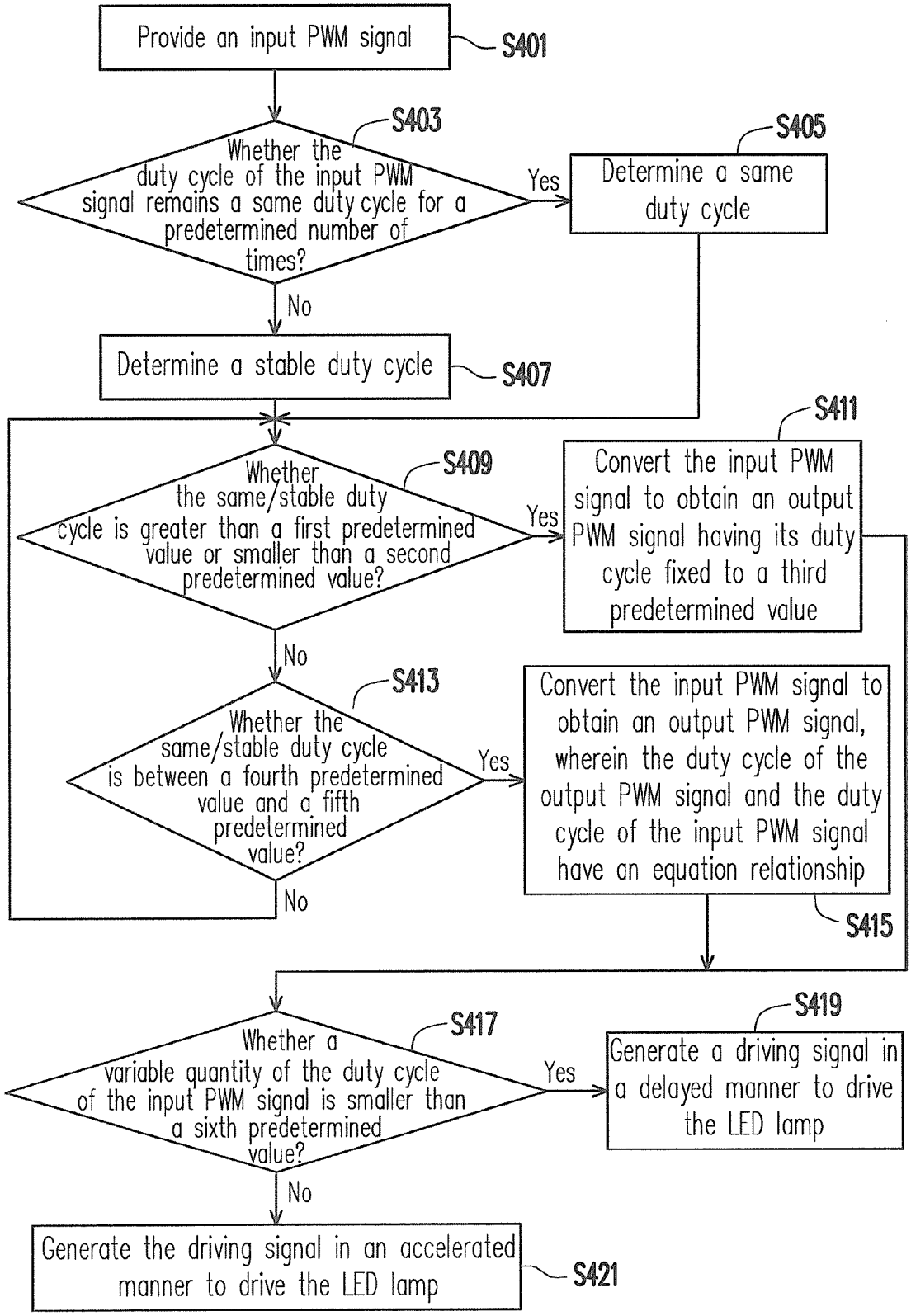
FIG. 4 is a flowchart of a method for driving a light emitting diode (LED) lamp according to an embodiment of the invention.

DESCRIPTION OF THE EMBODIMENTS.

It is to be understood that other embodiment may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Referring to both FIG. 1 and FIG. 2, an illumination system 100 includes a dimmer 101 and a lamp 103. The lamp 103 includes a conversion unit 201, a driver 203, and a lighting unit 205. The lighting unit 205 may be a light emitting diode (LED) module including a plurality of LEDs (not shown). Thereby, the lamp 103 is an LED lamp.

In the embodiment, the dimmer 101 provides an input pulse wide modulation (PWM) signal PWM_I in response to user operations. The lamp 103 is coupled to the dimmer 101. The lamp 103 receives the input PWM signal PWM_I from the dimmer 101 and provides a light beam according to an output PWM signal PWM_O related to the input PWM signal PWM_I, wherein a frequency of the input PWM signal PWM_I and a frequency of the output PWM signal PWM_O are different, and the frequency of the output PWM signal PWM_O has a fixed specific value (will be explained thereinafter).

To be specific, the conversion unit 201 receives the input PWM signal PWM_I from the dimmer 101 and converts the input PWM signal PWM_I into the output PWM signal PWM_O. In the embodiment, regardless of what the frequency of the input PWM signal PWM_I provided by the dimmer 101 is (for example, any frequency between 100 Hz and 1 KHz), the frequency of the output PWM signal PWM_O provided by the conversion unit 201 remains at aforementioned fixed specific value (for example, 300 Hz, however, not limited thereto). Besides, the driver 203 is coupled between the conversion unit 201 and the lighting unit 205. The driver 203 receives the output PWM signal PWM_O from the conversion unit 201 and generates a driving signal DS to drive LEDs in the lighting unit 205 according to the output PWM signal PWM_O.

In the embodiment, the conversion unit 201 has a built-in lookup table LUT (as shown in FIG. 3), and the conversion unit 201 obtains the output PWM signal PWM_O from the lookup table LUT according to the duty cycle PWM_I_D of the input PWM signal PWM_I provided by the dimmer 101 and provides the output PWM signal PWM_O to the driver 203. In other words, the duty cycle PWM_O_D of the output PWM signal PWM_O provided by the conversion unit 201 is determined by the duty cycle PWM_I_D of the input PWM signal PWM_I provided by the dimmer 101.

To be specific, the duty cycle PWM_O_D of the output PWM signal PWM_O obtained by the conversion unit 201 from the lookup table LUT according to the duty cycle PWM_I_D of the input PWM signal PWM_I provided by the dimmer 101 is fixed to a second predetermined value when the duty cycle PWM_I_D of the input PWM signal PWM_I provided by the dimmer 101 is greater or smaller than a first predetermined value.

For example, the duty cycle PWM_O_D of the output PWM signal PWM_O obtained by the conversion unit 201 from the lookup table LUT according to the duty cycle PWM_I_D of the input PWM signal PWM_I provided by the dimmer 101 is fixed to 100% when the duty cycle PWM_I_D of the input PWM signal PWM_I provided by the dimmer 101 is smaller than 5% (inclusive). Besides, the duty cycle PWM_O_D of the output PWM signal PWM_O obtained by the conversion unit 201 from the lookup table LUT according to the duty cycle PWM_I_D of the input PWM signal PWM_I provided by the dimmer 101 is fixed to 0% when the duty cycle PWM_I_D of the input PWM signal PWM_I provided by the dimmer 101 is greater than 95% (inclusive).

On the other hand, the duty cycle PWM_O_D of the output PWM signal PWM_O obtained by the conversion unit 201 from the lookup table LUT according to the duty cycle PWM_I_D of the input PWM signal PWM_I provided by the dimmer 101 and the duty cycle PWM_I_D of the input PWM signal PWM_I provided by the dimmer 101 have an equation relationship when the duty cycle PWM_I_D of the input PWM signal PWM_I provided by the dimmer 101 is between two predetermined values.

For example, the equation relationship between the duty cycle PWM_O_D of the output PWM signal PWM_O obtained by the conversion unit 201 from the lookup table LUT according to the duty cycle PWM_I_D of the input PWM signal PWM_I provided by the dimmer 101 and the duty cycle PWM_I_D of the input PWM signal PWM_I provided by the dimmer 101 is expressed as following equation 1 when the duty cycle PWM_I_D of the input PWM signal PWM_I provided by the dimmer 101 is between 5% (not inclusive) and 95% (not inclusive):

$$PWM_O_D=(96\%-PWM_I_D)\times(100/91) \qquad \text{Equation 1.}$$

Thus, the duty cycle PWM_O_D of the output PWM signal PWM_O obtained by the conversion unit 201 from the lookup table LUT according to the duty cycle PWM_I_D of the input PWM signal PWM_I provided by the dimmer 101 (10%) is 94.5% (i.e., (96%−10%)×(100/91)) when the duty cycle PWM_I_D of the input PWM signal PWM_I provided by the dimmer 101 is 10%. The values of the duty cycle PWM_I_D of the input PWM signal PWM_I and the duty cycle PWM_O_D of the output PWM signal PWM_O in other cases may be deduced accordingly.

As described above, the conversion unit 201 obtains an output PWM signal PWM_O having a duty cycle PWM_O_D of 50.5% (i.e., (96%−50%)×(100/91)) and a fixed frequency of 300 Hz from the lookup table LUT of the conversion unit 201 and provides the output PWM signal PWM_O to the driver 203 when the dimmer 101 provides an input PWM signal PWM_I having a duty cycle PWM_I_D of 50% and a frequency between 100 Hz and 1 KHz in response to a user operation. Thereby, the driver 203 generates a driving signal DS to drive LEDs in the lighting unit 205 according to the output PWM signal PWM_O (for example, by enhancing the driving capability of the output PWM signal PWM_O).

Namely, the driver 203 in the lamp 103 generates the driving signal DS for driving the lighting unit 205 (i.e., the LEDs) according to the converted output PWM signal PWM_O, and the frequency of the driving signal DS is equal to the frequency of the converted output PWM signal PWM_O instead of the frequency of the input PWM signal PWM_I. Thus, aforementioned problems in the conventional techniques may be effectively resolved by appropriately designing the frequency (for example, 300 Hz, but not limited thereto) of the output PWM signal PWM_O (in foregoing embodiment, because the frequency of the output PWM signal PWM_O is over the frequency range detectable by the human eye, signal transmission between various components of the driver 203 in the lamp 103 is not interfered, and the overall electromagnetic-interference (EMI) index of the lamp 103 is not be increased).

Additionally, in an actual application, the duty cycle of the input PWM signal PWM_I provided by the dimmer 101 varies in response to user's operations. Taking a rotary dimmer 101 as an example, because the rotation speed of the dimmer 101 is not fixed (namely, could be changed every now and then) but is controlled by a user, and the input PWM signal PWM_I received by the conversion unit 201 and the driving signal DS generated by the driver 203 have similar response curves and may produce a response difference, flickering may be produced in the light beam provided by the lamp 103 if the rotation speed of the dimmer 101 controlled by the user is too slow. On the other hand, if the rotation speed of the dimmer 101 controlled by the user is too fast, slow response and long adjustment time may be produced in the light beam provided by the lamp 103.

Accordingly, in other embodiments of the invention, the conversion unit 201 further controls the driver 203 to delay or accelerate the generation of the driving signal DS according to the variable quantity of the duty cycle PWM_I_D of the input PWM signal PWM_I provided by the dimmer 101. Thus, the conversion unit 201 controls the driver 203 to delay the generation of the driving signal DS when the conversion unit 201 determines that the variable quantity of the duty cycle PWM_I_D of the input PWM signal PWM_I provided by the dimmer 101 is smaller than a specific predetermined value. Otherwise, the conversion unit 201 controls the driver 203 to accelerate the generation of the driving signal DS.

For example, the conversion unit 201 determines that the rotation speed of the dimmer 101 controlled by the user is too slow and accordingly controls the driver 203 to generate the driving signal DS in a delayed manner when the conversion unit 201 determines that the variable quantity of the duty cycle PWM_I_D of the input PWM signal PWM_I provided by the dimmer 101 is smaller than 10% (i.e., the variation of the duty cycle PWM_I_D of the input PWM signal PWM_I provided at a previous time and at the current time by the dimmer 101, but not limited thereto). Accordingly, the response curve of the driving signal DS generated by the driver 203 is different from the response curve of the input PWM signal PWM_I received by the conversion unit 201 and is smoother. Thus, no flickering is produced in the light beam provided by the lamp 103 even if the rotation speed of the dimmer 101 controlled by the user is too slow.

Contrarily, the conversion unit 201 determines that the rotation speed of the dimmer 101 controlled by the user is too fast and accordingly controls the driver 203 to generate the driving signal DS in an accelerated manner when the conversion unit 201 determines that the variable quantity of the duty cycle PWM_I_D of the input PWM signal PWM_I provided by the dimmer 101 is greater than 10%. Accordingly, the response difference between the input PWM signal PWM_I received by the conversion unit 201 and the driving signal DS generated by the driver 203 is effectively reduced. Thus, slow response or long adjustment time may not be produced in the light beam provided by the lamp 103 even if the rotation speed of the dimmer 101 controlled by the user is too fast.

Moreover, in an actual application, the dimmer 101 may be rotated by the user to a position making the duty cycle PWM_I_D of the input PWM signal PWM_I received by the conversion unit 201 to fall on a threshold (for example, 50.9% to 51%). In this case, the conversion unit 201 looks up in the lookup table LUT of the conversion unit 201 by alternatively using the input PWM signal PWM_I having the duty cycle PWM_I_D of 50% and 51% and accordingly alternatively provides the output PWM signal PWM_O having the duty cycle PWM_O_D of 49.4% (corresponding to the input PWM signal PWM_I having the duty cycle PWM_I_D of 50%) and 50.5% (corresponding to the input PWM signal PWM_I having the duty cycle PWM_I_D of 51%) to the driver 203. As a result, the light beam provided by the lamp 103 becomes unstable.

Accordingly, in other embodiments of the invention, the conversion unit 201 further detects the duty cycle PWM_I_D of the input PWM signal PWM_I provided by the dimmer 101. The conversion unit 201 obtains the output PWM signal PWM_O from the lookup table LUT in the conversion unit 201 according to a same duty cycle and provides the output PWM signal PWM_O to the driver 203 when the conversion unit 201 detects that the duty cycle PWM_I_D of the input PWM signal PWM_I provided by the dimmer 101 remains the same duty cycle for a predetermined number of times.

For example, the conversion unit 201 obtains the output PWM signal PWM_O having a duty cycle PWM_O_D of 50.5% (i.e., (96%−50%)×(100/91)) from the lookup table LUT of the conversion unit 201 according to the input PWM signal PWM_I having a duty cycle PWM_I_D of 50% and provides the output PWM signal PWM_O to the driver 203 when the conversion unit 201 detects that the duty cycle PWM_I_D of the input PWM signal PWM_I provided by the dimmer 101 remains 50% for five continuous times (not limited thereto).

Contrarily, when the conversion unit 201 detects that the duty cycle PWM_I_D of the input PWM signal PWM_I provided by the dimmer 101 does not remain the same duty cycle for the predetermined number of times, the conversion unit 201 determines a stable duty cycle according to a variation pattern of the duty cycle PWM_I_D of the input PWM signal PWM_I provided by the dimmer 101, and the conversion unit 201 then obtains the output PWM signal PWM_O from the lookup table LUT of the conversion unit 201 according to the stable duty cycle and provides the output PWM signal PWM_O to the driver 203.

In the embodiment, the variation pattern of the duty cycle PWM_I_D of the input PWM signal PWM_I provided by the dimmer 101 may indicate that the duty cycle PWM_I_D of the input PWM signal PWM_I changes from large to small or from small to large. Besides, the stable duty cycle determined by the conversion unit 201 is greater than the duty cycle PWM_I_D of the input PWM signal PWM_I when the variation pattern of the duty cycle PWM_I_D of the input PWM signal PWM_I provided by the dimmer 101 indicates that the duty cycle PWM_I_D of the input PWM signal PWM_I changes from large to small. Otherwise, the stable duty cycle determined by the conversion unit 201 is smaller than the duty cycle PWM_I_D of the input PWM signal PWM_I.

For example, the conversion unit 201 determines the stable duty cycle based on whether the duty cycle PWM_I_D of the input PWM signal PWM_I previously provided by the dimmer 101 changes from a duty cycle PWM_I_D greater than 51% to a duty cycle PWM_I_D between 50.9 and 51% or changes a duty cycle PWM_I_D smaller than 50% to a duty cycle PWM_I_D between 50.9 and 51% when the conversion unit 201 detects that the duty cycle PWM_I_D of the input PWM signal PWM_I provided by the dimmer 101 does not remain the same duty cycle for five continuous times (for example, the duty cycle PWM_I_D changes between 50.9% and 51%).

To be specific, assuming that the conversion unit 201 determines that the duty cycle PWM_I_D of the input PWM signal PWM_I previously provided by the dimmer 101 changes from a duty cycle PWM_I_D greater than 51% to a duty cycle PWM_I_D between 50.9 and 51%, the conversion unit 201 determines a stable duty cycle of 51% and obtains an output PWM signal PWM_O having a duty cycle PWM_O_D of 49.4% (i.e., (96%−51%)×(100/91)) from the lookup table LUT of the conversion unit 201 to provide to the driver 203.

Additionally, assuming that the conversion unit 201 determines that the duty cycle PWM_I_D of the input PWM signal PWM_I previously provided by the dimmer 101 changes from a duty cycle PWM_I_D smaller than 50% to a duty cycle PWM_I_D between 50.9 and 51%, the conversion unit 201 determines a stable duty cycle of 50% and obtains an output PWM signal PWM_O having a duty cycle PWM_O_D of 50.5% (i.e., (96%−50%)×(100/91)) from the lookup table LUT of the conversion unit 201 to provide to the driver 203.

Accordingly, in the embodiment, even though the dimmer 101 is rotated by the user to a position that makes the duty cycle PWM_I_D of the input PWM signal PWM_I received by the conversion unit 201 falls on a threshold (for example, between 50.9% and 51%), the conversion unit 201 looks up the lookup table LUT of the conversion unit 201 according to the input PWM signal PWM_I having a duty cycle PWM_I_D of 50% or 51%, so that the light beam provided by the lamp 103 may be stabilized.

A method for driving an LED lamp is provided based on the embodiments described above, as illustrated in FIG. 4. The LED lamp driving method in the embodiment includes following steps.

An input PWM signal is provided (step S401).

Whether the duty cycle of the input PWM signal remains a same duty cycle for a predetermined number of times is determined (step S403).

If the duty cycle of the input PWM signal remains the same duty cycle for the predetermined number of times, the same duty cycle is determined (step S405). Otherwise, a stable duty cycle is determined (step S407). Herein the stable duty cycle is determined according to a variation pattern of the duty cycle of the input PWM signal, wherein the stable duty cycle is greater than the duty cycle of the input PWM signal when the variation pattern indicates that the duty cycle of the input PWM signal changes from large to small, and the stable duty cycle is smaller than the duty cycle of the input PWM signal when the variation pattern indicates that the duty cycle of the input PWM signal changes from small to large.

After determining the same/stable duty cycle, whether the same/stable duty cycle is greater than a first predetermined value (for example, 95% (inclusive), but is not limited thereto) or smaller than a second predetermined value (for example, 5% (inclusive), but is not limited thereto) is determined (step S409).

When the same/stable duty cycle is greater than the first predetermined value or smaller than the second predetermined value, the input PWM signal is converted (for example, by looking up the lookup table according to the duty cycle of the input PWM signal) to obtain the output PWM signal having its duty cycle fixed to a third predetermined value (step S411), wherein a frequency of the input PWM signal and a frequency of the output PWM signal are different, and the frequency of the output PWM signal has a fixed specific value (for example, 300 Hz, but is not limited thereto). Otherwise, whether the same/stable duty cycle is between a fourth predetermined value and a fifth predetermined value (for example, between 5% (not inclusive) and 95% (not inclusive), but is not limited thereto) is determined (step S413).

When the same/stable duty cycle is between the fourth predetermined value and the fifth predetermined value, the input PWM signal is converted (for example, by looking up the lookup table according to the duty cycle of the input PWM signal) to obtain an output PWM signal (step S415). Herein the duty cycle of the output PWM signal and the duty cycle of the input PWM signal have an equation relationship. If the duty cycle of the input PWM signal is indicated as PWM_I_D, and the duty cycle of the output PWM signal is indicated as PWM_O_D, the equation relationship may be expressed as: PWM_O_D=(96%−PWM_I_D)×(100/91). When the same/stable duty cycle is not between the fourth predetermined value and the fifth predetermined value, whether the same/stable duty cycle is greater than the first predetermined value or smaller than the second predetermined value is determined again (step S409).

After obtaining the output PWM signal, a variable quantity of the duty cycle of the input PWM signal is determined (step S417).

If the variable quantity of the duty cycle of the input PWM signal is smaller than a sixth predetermined value, a driving signal is generated according to the output PWM signal in a delayed manner to drive the LED lamp (step S419). If the variable quantity of the duty cycle of the input PWM signal is greater than the sixth predetermined value, the driving signal is generated according to the output PWM signal in an accelerated manner to drive the LED lamp (step S421).

In summary, the embodiment or embodiments of the invention may have at least one of the following advantages. According to foregoing embodiments of the invention, a driver in a lamp generates a driving signal DS for driving a lighting unit (i.e., LEDs) according to a converted output PWM signal PWM_O, and the frequency of the driving signal DS is equal to the frequency of the output PWM signal PWM_O instead of the frequency of the input PWM signal PWM_I. Thus, the problems in the conventional techniques may be effectively resolved by appropriately designing the frequency (for example, 300 Hz) of the output PWM signal PWM_O (in an embodiment of the invention, because the frequency of the output PWM signal is over a frequency range detectable by the human eye, signal transmission between various components of the driver in the lamp is not interfered, and the overall EMI index of the lamp is not increased).

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the present disclosure is intended to be dedicated to the public regardless of whether the element or component is explicitly recited in the following claims.

What is claimed is:

1. A lamp, comprising:

a lighting unit;

a conversion unit, receiving an input pulse width modulation (PWM) signal and converting the input PWM signal into an output PWM signal, wherein a frequency of the input PWM signal and a frequency of the output PWM signal are different; and a driver, coupled between the lighting unit and the conversion unit, receiving the output PWM signal and generating a driving signal to drive the lighting unit according to the output PWM signal, wherein the conversion unit has a lookup table, and the conversion unit obtains the output PWM signal from the lookup table according to a duty cycle of the input PWM signal, wherein the conversion unit controls the driver to delay or accelerate a generation of the driving signal according to a variable quantity of the duty cycle of the input PWM signal, wherein the conversion unit controls the driver to delay the generation of the driving signal when the conversion unit determines that the variable quantity of the duty cycle of the input PWM signal is smaller than a predetermined value, and the conversion unit controls the driver to accelerate the generation of the driving signal when the conversion unit determines that the variable quantity of the duty cycle of the input PWM signal is greater than the predetermined value.

2. The lamp according to claim 1, wherein the frequency of the output PWM signal has a fixed specific value;

the conversion unit detects the duty cycle of the input PWM signal;

the conversion unit obtains the output PWM signal from the lookup table according to a same duty cycle when the conversion unit detects that the duty cycle of the input PWM signal remains the same duty cycle for a predetermined number of times;

the conversion unit determines a stable duty cycle according to a variation pattern of the duty cycle of the input PWM signal and takes the stable duty cycle as an duty cycle of the input PWM signal to obtains the output PWM signal from the lookup table when the conversion unit detects that the duty cycle of the input PWM signal does not remain the same duty cycle for the predetermined number of times, wherein the variation pattern indicates that the duty cycle of the input PWM signal changes from large to small or from small to large, wherein the stable duty cycle is equal to the largest duty cycle of the input PWM signal when the variation pattern indicates that the duty cycle of the input PWM signal changes from large to small, wherein the stable duty cycle is equal to the smallest duty cycle of the input PWM signal when the variation pattern indicates that the duty cycle of the input PWM signal changes from small to large.

3. The lamp according to claim 2, wherein the lighting unit comprises a light emitting diode (LED) module.

4. The lamp according to claim 1, wherein a duty cycle of the output PWM signal obtained by the conversion unit from the lookup table according to the duty cycle of the input PWM signal is fixed to a second predetermined value when the duty cycle of the input PWM signal is greater or smaller than a first predetermined value.

5. The lamp according to claim 1, wherein a duty cycle of the output PWM signal obtained by the conversion unit from the lookup table according to the duty cycle of the input PWM signal and the duty cycle of the input PWM signal have an equation relationship when the duty cycle of the input PWM signal is between a first predetermined value and a second predetermined value, wherein the duty cycle of the input PWM signal is indicated as PWM_I_D, the duty cycle of the output PWM signal is indicated as PWM_O_D, and the equation relationship is PWM_O_D=(96%−PWM_I_D)×(100/91), wherein the duty cycle PMW_I_D is greater than 5% and less than 95%.

6. An illumination system, comprising:

a dimmer, providing an input pulse width modulation (PWM) signal; and a lamp, coupled to the dimmer, receiving the input PWM signal and providing a light beam according to an output PWM signal related to the input PWM signal, wherein a frequency of the input PWM signal and a frequency of the output PWM signal are different, and the lamp comprising:

a lighting unit;

a conversion unit, receiving the input PWM signal and converting the input PWM signal into the output PWM signal; and a driver, coupled between the lighting unit and the conversion unit, receiving the output PWM signal and generating a driving signal to drive the lighting unit according to the output PWM signal, wherein the conversion unit has a lookup table, and the conversion unit obtains the output PWM signal from the lookup table according to a duty cycle of the input PWM signal, wherein the conversion unit controls the driver to delay or accelerate a generation of the driving signal according to a variable quantity of the duty cycle of the input PWM signal, wherein the conversion unit controls the driver to delay the generation of the driving signal when the conversion unit determines that the variable quantity of the duty cycle of the input PWM signal is smaller than a predetermined value, and the conversion unit controls the driver to accelerate the generation of the driving signal when the conversion unit determines that the variable quantity of the duty cycle of the input PWM signal is greater than the predetermined value.

7. The illumination system according to claim 6, wherein the frequency of the output PWM signal has a fixed specific value.

8. The illumination system according to claim 6, wherein a duty cycle of the output PWM signal obtained by the conversion unit from the lookup table according to the duty cycle of the input PWM signal is fixed to a second predetermined value when the duty cycle of the input PWM signal is greater or smaller than a first predetermined value.

9. The illumination system according to claim 6, wherein a duty cycle of the output PWM signal obtained by the conversion unit from the lookup table according to the duty cycle of the input PWM signal and the duty cycle of the input PWM signal have an equation relationship when the duty cycle of the input PWM signal is between a first predetermined value and a second predetermined value, wherein the duty cycle of the input PWM signal is indicated as PWM_I_D, the duty cycle of the output PWM signal is indicated as PWM_O_D, and the equation relationship is PWM_O_D=(96%−PWM_I_D)×(100/91), wherein the duty cycle PMW_I_D is greater than 5% and less than 95%.

10. The illumination system according to claim 6, wherein the conversion unit detects the duty cycle of the input PWM signal;

the conversion unit obtains the output PWM signal from the lookup table according to a same duty cycle when the conversion unit detects that the duty cycle of the input PWM signal remains the same duty cycle for a predetermined number of times;

the conversion unit determines a stable duty cycle according to a variation pattern of the duty cycle of the input PWM signal and takes the stable duty cycle as an duty cycle of the input PWM signal to obtains the output PWM signal from the lookup table when the conversion unit detects that the duty cycle of the input PWM signal does not remain the same duty cycle for the predetermined number of times, wherein the variation pattern indicates that the duty cycle of the input PWM signal changes from large to small or from small to large;

the stable duty cycle is the largest duty cycle of the input PWM signal when the variation pattern indicates that the duty cycle of the input PWM signal changes from large to small;

the stable duty cycle is the smallest duty cycle of the input PWM signal when the variation pattern indicates that the duty cycle of the input PWM signal changes from small to large.

11. The illumination system according to claim 6, wherein the lighting unit comprises a light emitting diode (LED) module.

12. A method for driving a light emitting diode (LED) lamp, comprising:

providing an input pulse width modulation (PWM) signal;

converting the input PWM signal into an output PWM signal, wherein a frequency of the input PWM signal and a frequency of the output PWM signal are different, wherein the step of converting the input PWM signal into the output PWM signal comprises:

obtaining the output PWM signal from a lookup table according to a duty cycle of the input PWM signal; and generating a driving signal to drive the LED lamp according to the output PWM signal, wherein before the step of generating the driving signal, the driving method further comprises: determining whether to delay or accelerate a generation of the driving signal according to a variable quantity e of the duty cycle of the input PWM signal, wherein the generation of the driving signal is delayed when the variable quantity of the duty cycle of the input PWM signal is smaller than a predetermined value, and the generation of the driving signal is accelerated when the variable quantity of the duty cycle of the input PWM signal is greater than the predetermined value.

13. The driving method according to claim 12, wherein the frequency of the output PWM signal has a fixed specific value.

14. The driving method according to claim 12, wherein before the step of converting the input PWM signal into the output PWM signal, the driving method further comprises:

determining whether the duty cycle of the input PWM signal is greater or smaller than a first predetermined value.

15. The driving method according to claim 14, wherein a duty cycle of the output PWM signal obtained from the lookup table according to the duty cycle of the input PWM signal is fixed to a second predetermined value when the duty cycle of the input PWM signal is greater or smaller than the first predetermined value.

16. The driving method according to claim 14, wherein before the step of determining whether the duty cycle of the input PWM signal is greater or smaller than the first predetermined value, the driving method further comprises:

detecting whether the duty cycle of the input PWM signal remains a same duty cycle for a predetermined number of times, wherein the output PWM signal is obtained from the lookup table according to the same duty cycle when the duty cycle of the input PWM signal remains the same duty cycle for the predetermined number of times;

when the duty cycle of the input PWM signal does not remain the same duty cycle for the predetermined number of times, a stable duty cycle is determined according to a variation pattern of the duty cycle of the input PWM signal, and the stable duty cycle is taken as an duty cycle of the input PWM signal to determine the output PWM signal from the lookup table, wherein the variation pattern indicates that the duty cycle of the input PWM signal changes from large to small or from small to large, wherein the stable duty cycle is equal to the largest duty cycle of the input PWM signal when the variation pattern indicates that the duty cycle of the input PWM signal changes from large to small, and the stable duty cycle is equal to the smallest duty cycle of the input PWM signal when the variation pattern indicates that the duty cycle of the input PWM signal changes from small to large.

17. The driving method according to claim 12, wherein before the step of converting the input PWM signal into the output PWM signal, the driving method further comprises:

determining whether the duty cycle of the input PWM signal is between a first predetermined value and a second predetermined value.

18. The driving method according to claim 17, wherein a duty cycle of the output PWM signal obtained from the lookup table according to the duty cycle of the input PWM signal and the duty cycle of the input PWM signal have an equation relationship when the duty cycle of the input PWM signal is between the first predetermined value and the second predetermined value, wherein the duty cycle of the input PWM signal is indicated as PWM_I_D, the duty cycle of the output PWM signal is indicated as PWM_O_D, and the equation relationship is $PWM_O_D=(96\%-PWM_I_D)\times(100/91)$, wherein the duty cycle PMW_I_D is greater than 5% and less than 95%.

* * * * *